United States Patent [19]

Yamada et al.

[11] Patent Number: 4,920,726

[45] Date of Patent: May 1, 1990

[54] VACUUM-PACKING MACHINE

[76] Inventors: Chiharu Yamada, 17, Agari-machi, Seki-shi, Gifu-ken, 501-32; Hideto Yamada, 1065-14, Yamada, Seki-shi, Gifu-ken, 501-32, both of Japan

[21] Appl. No.: 266,744

[22] Filed: Nov. 3, 1988

[30] Foreign Application Priority Data

Nov. 17, 1987 [JP] Japan ..... 62-290145

[51] Int. Cl.[5] ..... B65B 31/04

[52] U.S. Cl. ..... 53/79; 53/129; 53/512

[58] Field of Search ..... 53/88, 97, 137, 79, 53/101, 129, 290, 405, 415, 434, 468, 486, 510, 512

[56] References Cited

U.S. PATENT DOCUMENTS

| | | | |
|---|---|---|---|
| 2,649,234 | 8/1953 | Taunton | 53/512 X |
| 2,896,385 | 7/1959 | Gebhardt | 53/512 |
| 3,245,200 | 4/1966 | Shaw | 53/512 |
| 3,246,444 | 4/1966 | Paisley | 53/412 |
| 3,452,510 | 7/1969 | Fry | 53/88 |
| 3,745,024 | 7/1973 | Ford et al. | 53/137 X |
| 4,534,154 | 8/1985 | Gaubert | 53/512 X |
| 4,581,764 | 4/1986 | Plock et al. | 53/512 X |
| 4,754,596 | 7/1988 | Yasumune et al. | 53/512 X |
| 4,779,398 | 10/1988 | Glandon et al. | 53/512 X |

*Primary Examiner*—Robert L. Spruill
*Assistant Examiner*—Beth Bianca
*Attorney, Agent, or Firm*—Stephen G. Rudisill

[57] ABSTRACT

A vacuum-packing machine for sucking the excess air from a wrapping bag containing granular substances and others, creating a vacuum inside the wrapping bag. The wrapping bag is placed on a base, and holes are made on the wrapping bag through a sucking hole by a puncturing device. The air inside the wrapping bag is then sucked by an air sucking device, after which, a piston moves, and a seal adhering to the surface of a sponge on top of the piston seals the holes on the wrapping bag. The seal is supplied to the sponge by a seal supplying device. An air blowing pipe is provided to facilitate the peeling off of the seal from a tape containing the seals.

3 Claims, 5 Drawing Sheets

VACUUM-PACKING MACHINE

FIELD OF THE INVENTION

The present invention relates to a vacuum-packing machine that vacuum-packs a wrapping bag by sucking the excess air out of the wrapping bag or a packing container containing grains such as rice, beans and coffee, or powdered or other forms of solid substances.

DESCRIPTION OF THE RELATED ART

At the present time, a vacuum-packing machine that can vacuum-pack a wrapping bag containing a powdered substance, or other substances, by a simple operation in a short period of time, is not being offered to the public.

SUMMARY OF THE INVENTION

It is the object of the present invention to provide a vacuum-packing machine that is capable of vacuum-packing by simple procedure, in a short period of time.

To realize the object mentioned above, the vacuum-packing machine of the present invention comprises a puncturing means for making holes on the wrapping bag, a sucking means functionally connected to the puncturing means, for sucking the excess air out of the wrapping bag through the holes on the wrapping bag, and a sealing means functionally connected to the sucking means, for sealing the holes on the wrapping bag.

Other and further objects of this invention will become obvious upon an understanding of the illustrative embodiments about to be described or indicated in the appended claims, and various advantages not referred to herein will occur to one skilled in the art upon employment of the invention in pactice.

DESCRIPTION OF THE PREFERRED EMBODIMENTS

An example embodying the present invention is described below with reference to FIG. 1 to FIG. 7.

Figure 1:
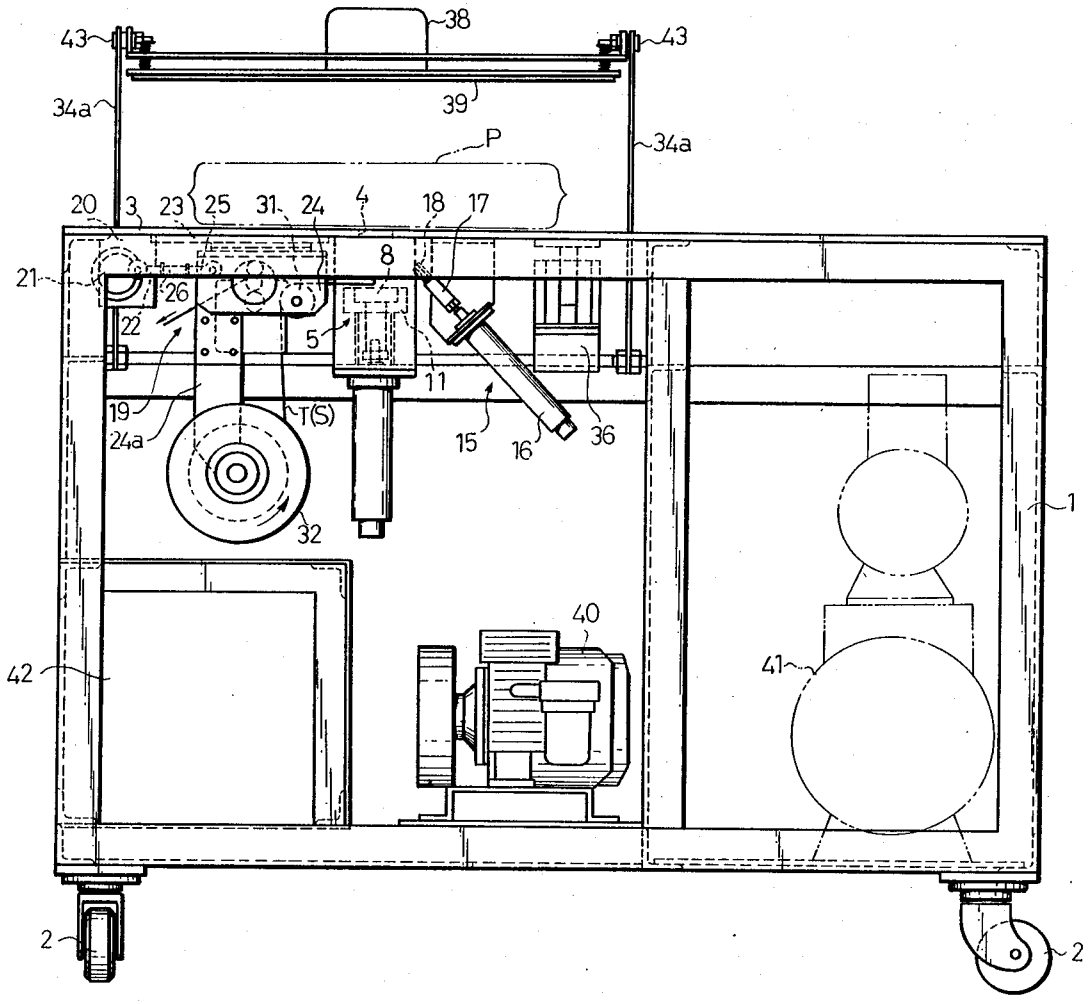
FIG.1 is a front view showing the vacuum-packing machine.

As shown in FIG. 1, a flat base 3, where a wrapping bag P that is to be vacuum-packed is placed, is provided on the upper surface of a mobile main body 1 equipped with four wheels 2 at its lower surface. A circular sucking hole 4 for performing the sucking operation on the wrapping bag P is made on the central portion of the base 3. A vertically movable air sucking apparatus 5, serving as a sucking means, is provided below this sucking hole 4. A description of this air sucking apparatus 5 is given next.

Figure 3:
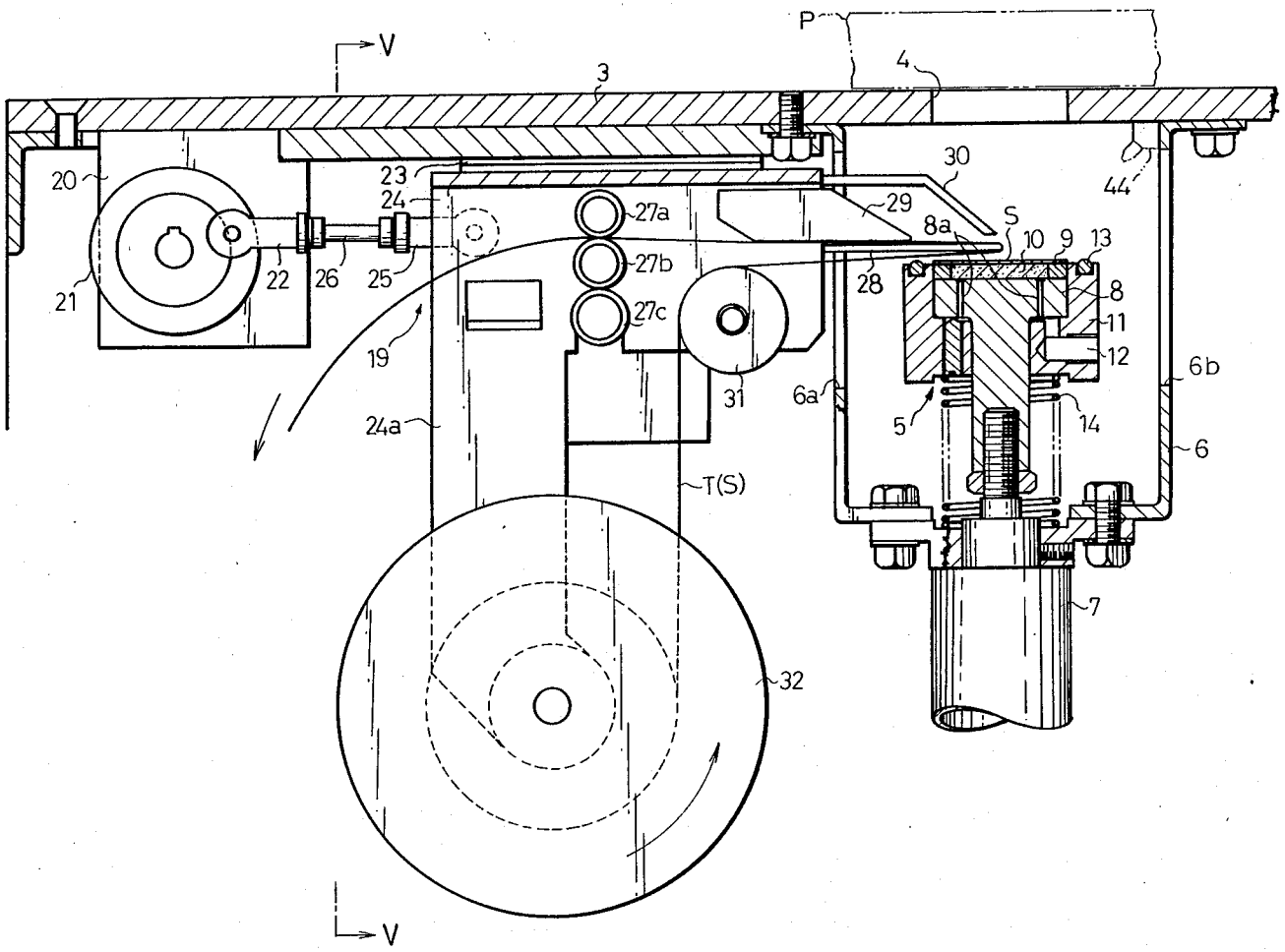
FIG. 3 and FIG. 4 are enlarged partial cross sectional views of FIG. 1.
Figure 6:
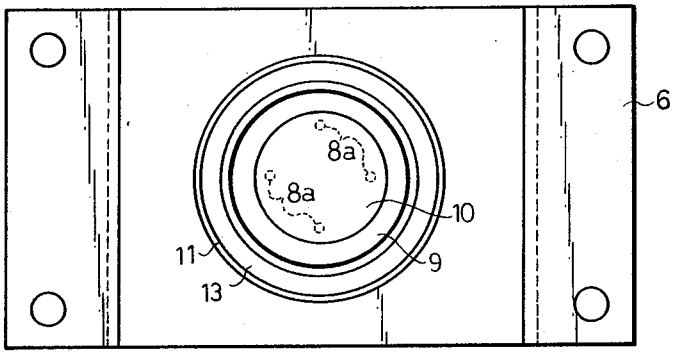
FIG. 6 is a plane figure of the air sucking apparatus.
Figure 7:
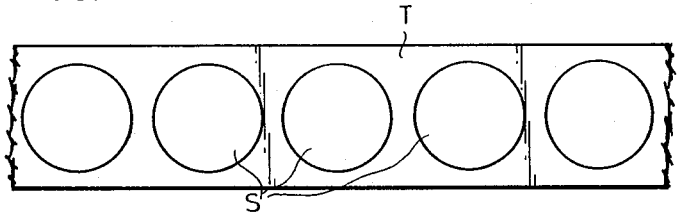
FIG. 7 is a plane figure of a tape with seals stuck to it.

As shown in FIG. 3, a hole 6a for supplying a tape T with seals S stuck on its back surface, as shown in FIG. 7, is provided on the left side of a bracket 6 fixed by bolts to the lower surface of the base 3 mentioned above. A hole 6*b* through which puncturing needles pass to make holes on the lower surface of the wrapping bag P is provided on the right side of the bracket 6. An air cylinder 7 is fixed by bolts on the lower portion of the same bracket 6. A piston 8, having a T-shaped cross section and serving as an attaching means, is connected to the rod of the cylinder 7. The piston 8 is vertically movable due to the action of the cylinder 7. Further, the diameter of the top portion of the piston 8 is a little bit smaller than the diameter of the sucking hole 4, the piston 8 being capable of passing through the sucking hole 4 from below. Four sucking holes 8a are provided on the top portion of the piston 8, as shown in FIG. 6. The sucking holes 8a serve to suck the seal S.

A ring-shaped rubber piece 9, serving as an air-blocking elastic body, is provided around the circumference of the upper surface of the piston 8. A sponge 10, serving as an elastic foam substance, is provided in the inner side of the rubber piece 9. Since the air is sucked only through the sponge 10 due to the rubber piece's 9 serving as an air block, the seal S for sealing up the wrapping bag P adheres to the sponge 10 by surface adsorption on the upper surface of the sponge 10.

Figure 4:
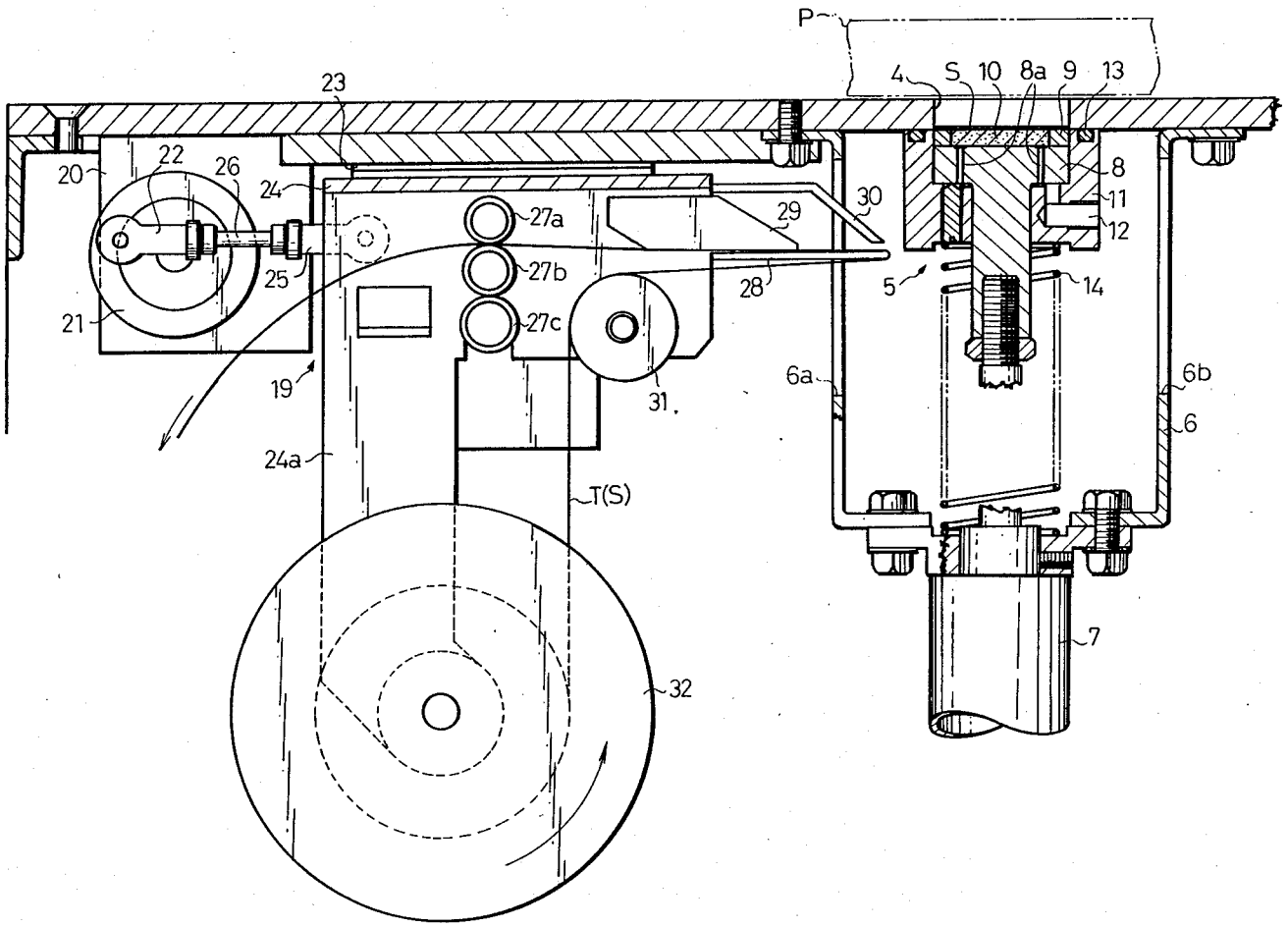

A housing 11, having the shape of a circular cylinder, is provided around the circumference of the piston 8, with a small gap between it and the piston 8. A hole 12 having an L-shaped cross section is provided on the side of this housing 11. A pipe from a vacuum pump for sucking air is inserted into and fixed to this hole 12. Further, an O-ring 13 made of rubber, serving as a sealing means, is provided on the upper end of the housing 11, so that air does not leak when the housing 11 moves upward and becomes pressed against the lower surface of the base 3, as shown in FIG. 4. A spring 14 is provided between the lower surface of the housing 11 and the upper surface of the air cylinder 7. This spring 14 acts to force the housing 11 upward, and, when the piston 8 moves upward due to the action of the air cylinder 7, allows the housing 11 to move upward accordingly.

As shown in FIG. 4, the housing 11 moves upward due to the force of the spring 14, simultaneous with the upward movement of the piston 8 due to the action of the air cylinder 7. When this happens, the upper surface of the housing 11 becomes pressed against the lower surface of the base 3, thereby closing up the sucking hole 4. In this state, the air inside the wrapping bag P is sucked via the hole 12 on the housing 11, and the small gap between the housing 11 and the piston 8. After the air has been sucked, and a prescribed degree of vacuum is reached, a sensor, not shown in the illustrations, is activated. The piston 8 further moves upward through the sucking hole 4 of the base 3, and the seal S on the upper surface of the piston 8 is stuck on the lower surface of the wrapping bag P.

As shown in FIG. 1, a puncturing apparatus 12, serving as a puncturing means, is provided on the left side of the air sucking apparatus 5. A description of this puncturing apparatus 15 is given next.

A mounting plate 17 is fixed to the upper portion of an air cylinder 16 fixed to the main body 1. A plurality of puncturing needles 18 is installed on the front end portion of the mounting plate 17. The puncturing needles 18 are installed such that they are capable of reciprocating motion by the action of the air cylinder 16, in a diagonal direction relative to the sucking hole 4. When the puncturing needles 18 are in the protruded state, they come in contact with the lower surface of the wrapping bag P and create holes on it. After the holes have been made, the puncturing needles 18 withdraw downward in a diagonal direction, such that they do not interfere with the upward movement of the piston 8 and the housing 11 of the air sucking apparatus 15.

A seal supplying apparatus 19, serving as a supplying means, is provided on the opposite side of the puncturing apparatus 15 of the air sucking apparatus 5. A description of this seal supplying apparatus 19 is given next.

Figure 5:
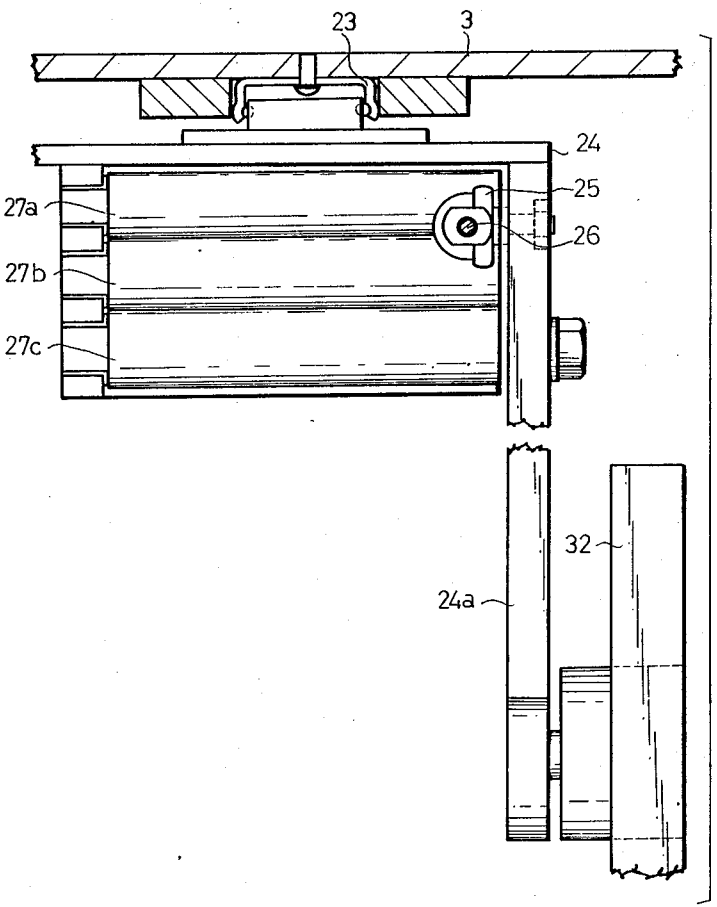
FIG. 5 is a cross sectional view along the line V—V in FIG. 3.

As shown in FIG. 3, a rotary piece 21 rotated by a motor is mounted on a mounting piece 20 fixed to the lower surface of the left end portion of the base 3. A linking piece 22 is rotatably supported on the perimeter of the rotary piece 22. As shown in FIG. 5, a guide rail 23 is installed on the lower surface of the base 3, between the mounting piece 20 and the sucking hole 4. A movable piece 24 is suspended from the guide rail 23 such that it can be moved in the horizontal direction. A linking piece 25 is rotatably supported on the left end portion of the movable piece 24. This linking piece 25 and the linking piece 22 are connected by a rod 26. When the rotary piece 21 rotates, the movable piece 24 moves horizontally via the linking piece 22, rod 26 and the linking piece 25.

As shown in FIG. 3 to FIG. 5, three upper and lower rollers **27*a*, 27*b*, 27*c* rotated by the motor are arranged on top of each other in the middle portion of the movable piece 24. These rollers 27*a*, 27*b*, 27*c* are in contact with each other, and are controlled to rotate intermittently. The part of the tape T having the seals S peeled off its back surface passes between the rollers 27*a* and 27*b***.

Further, as shown in FIG. 3 and FIG. 4, a guiding piece 28 is provided on the right end portion of the moving piece 24. The tape T is guided to the right by this guiding piece 28, makes a 180 degree turn at the front end portion of the guiding piece 28, returning in the opposite direction. A pressing piece 29 for guiding the tape T to the left, along the guiding piece 28, is provided on the upper surface of the guiding piece 28. Further, an air blowing pipe 30 is provided to the right of the pressing piece 29, on the right end of the movable piece 24. This air blowing pipe 30 serves as an auxiliary means for causing the seal S to adhere to the upper surface of the piston 8 when the tape T makes a 180 degree turn at the front end of the guiding piece 28. A guide roller 31 is provided on the lower right portion of the movable piece 24, guiding the tape T toward the guiding piece 28.

A tape reel 32 is rotatably provided on the lower end of a mounting portion **24*a* extending downward from the movable piece 24. A tape T bearing the seals S is wound around this tape reel 32**.

Figure 2:
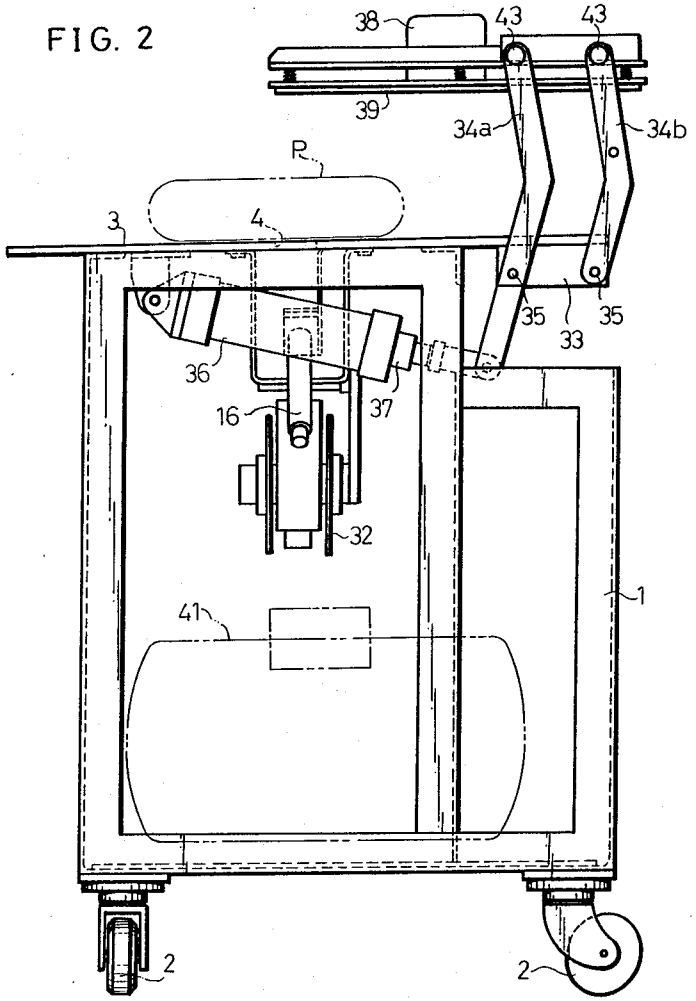
FIG.2 is a right side view of FIG. 1.

As shown in FIG. 2, mounting plates 33 are installed on the rear portion of the base 3, at positions to the right of the puncturing apparatus 15 and to the left of the seal supplying apparatus 19. As shown in FIG. 1, a pair of angle-shaped front and rear arms **34*a*, 34*b* are rotatably supported by shafts 35 on each mounting plate 33. The front end of a piston 37 of an air cylinder 36 is rotatably connected to the lower end of the front arm 34*a*. Further, the upper ends of the arms 34*a*, 34*b* are rotatably connected through shafts 43 to a flat body 39 bearing a vibrator 38**.

Then, when the piston 37 moves rearward due to the action of the air cylinder 36, the arm **34*a* rotates about the shaft 35, the flat body 39 bearing the vibrator 38 descends to the front while maintaining its horizontal position, until it presses the wrapping bag P on the base 3. Afterward, when the vibrator 38** is activated, the rice, for example, inside the wrapping bag P is shaken, fixing the shape of the wrapping bag P.

As shown in FIG. 1, a vacuum pump 40 is provided on the central lower portion inside the main body 1. A pipe (not shown in the illustrations) from the vacuum pump 40, used for sucking air, is connected to the hole 12 of the air sucking apparatus 5. An air compressor 41 is provided on the lower right side on the interior of the main body 1. This air compressor 41 serves to send compressed air to the air cylinder 7 of the air sucking apparatus 5, the air cylinder 16 of the puncturing apparatus 15, and the air cylinder 36. A tool compartment 42 is also provided on the lower left portion inside the main body 1.

Next, the operation as well as the effects of the vacuum-packing machine constructed in the manner described above is mentioned.

First, the tape T wound around the tape reel 32 below the base 3 is guided along the lower portion of the guiding piece 28 through the guide roller 31, makes a 180 degree turn at the front end portion of the guiding piece 28, passes below the lower surface of the pressing piece 29 and through the interval between the rollers **27*a*, and 27*b***.

Next, as shown in FIG. 1, a wrapping bag P containing rice, for example, having an excess amount of air inside is placed on the bag 3. Then, as shown in FIG. 2, with the activation of the air cylinder 36, the piston 37 protrudes rearward. As a result, the arms **34*a*, 34*b* rotate about the shafts 35, and the flat body 39 bearing the vibrator 38 descends while maintaining its horizontal position, until it comes in contact with the upper surface of the wrapping bag P. Finally, while the housing 11 and the piston 8 in the air sucking apparatus 5 are in the lowered position, the rotary piece 21 is rotated by the motor, causing the movable piece 24 to move to the right via the linking piece 22, rod 26 and the linking piece 25**.

Consequently, as shown in FIG. 3, the front end portion of the guiding piece 28 is positioned directly above the approximately central portion of the piston 8 or over the sucking holes **8*a*. In this state, when the rollers 27*a*, 27*b* are rotated by the motor, the front end portion of a seal S stuck on the back surface of the tape T is peeled off due to the fact that the tape T makes a 180 degree turn at the front end portion of the guiding piece 28. On the other hand, in the air sucking apparatus 5, air is being sucked by the vacuum pump 40 from the entire upper surface of the sponge 10 via the hole 12 of the housing 11 and the hole 8a of the piston 8. Also, consequently, the seal S remains adhered to upper surface of the sponge 10. Since a sponge 10 is being used, other substances like dust are prevented from being transported to the vacuum pump 40 via the holes 8*a*, 12**.

Since, in this state, air is being blown by the air blowing pipe 30 onto the front end portion of the seal S (refer to the left hand side of FIG. 3), it becomes easier for the seal S to adhere to the upper surface of the sponge 10. During this time, rotation of the rollers **27*a*, 27*b*** stops.

Afterward, the rotary piece 21 is rotated in the same manner as before, moving the movable piece 24 to the left via the linking piece 22, rod 26 and the linking piece 25. As a result, the guiding piece 28 on the right end of the movable piece 24, the pressing piece 29 and the air blowing pipe 30 are moved to the left accordingly, away from the position in which the air sucking apparatus 5 moves upward to.

Next, in the puncturing apparatus 15, when the air cylinder 16 is activated, the puncturing needles 18 move diagonally upward through the sucking hole 4 on the base 3, toward the lower surface of the wrapping bag P, and make holes on the wrapping bag P. Since the holes made on the wrapping bag P are very small, the rice granules inside do not spill out of the wrapping bag P. Simultaneous with this puncturing operation, the vibrator 38 on the flat plate 39 becomes activated, shaking the wrapping bag P horizontally (left to right in FIG. 1), thus efficiently adjusting the general shape of the wrapping bag P containing the rice granules.

Next, in the air sucking apparatus 5, simultaneous with the upward movement of the piston 8 due to the action of the air cylinder 7, the housing 11 moves upward due to the force of the spring 14. Then, as shown in FIG. 4, the O-ring 13 on the upper surface of the housing 11 becomes pressed against the lower surface of the base 3, closing up the sucking hole 4. In this state, air is sucked by the vacuum pump 40 from the gap between the housing 11 and the piston 8 through the hole 12 of the housing 11. As a result, air is sucked from the interior of the wrapping bag P through the holes made on the lower surface of the wrapping bag P.

Then, when the degree of vacuum has reached a prescribed level, a sensor (not shown in the illustrations) is activated. The piston 8 moves further upward through the sucking hole 4 due to the action of the air cylinder 7, the upper surface of the piston 8 coming in contact with the lower surface of the wrapping bag P. As a result, the seal S adhering to the upper surface of the piston 8 becomes glued to the lower surface of the wrapping bag P, covering the holes made on the wrapping bag P. Automatic vacuum-packing is thus performed according to the operations described above. Afterward, the piston 8 moves downward due to the action of the air cylinder 7. Then, since the piston 8 presses the housing 11 downward, the housing 11 moves downward, against the force of the spring 14. The bag of rice, vacuum-packed to a prescribed degree of vacuum, takes the form of a hard flattened commodity. Being vacuum-packed, the quality of the product contained in the bag can be maintained for a long period of time.

Next, when the piston 37 moves forward with the activation of the air cylinder 36, the arms 34*a*, 34*b* rotate about the shafts 35, and the flat body 39 moves upward, away from the upper surface of the wrapping bag P, and returns to its original position (the position shown in FIG. 2). In this state, the vacuum-packed bag P of rice is taken away from the base 3, a new wrapping bag P is placed on the base 3, and vacuum-packing is performed successively by a repetition of the operations mentioned above.

As mentioned above, in the vacuum-packing machine of the present embodiment, with the operation of placing a bag P of rice on top of the bag 3, and a succession of the automatic operations of making holes with the puncturing apparatus 15, sucking the air with the air sucking apparatus 5, and putting a seal with the seal supplying apparatus 19 and the air sucking apparatus 5, a simple and quick vacuum-packing procedure can be performed.

The present invention is not limited to the embodiment mentioned above, but can also be constructed according to the following:

(1) In the above embodiment, the puncturing apparatus 15 is installed in a diagonal position. The angle of inclination of the puncturing apparatus 15 can take any value; the puncturing apparatus can even be installed vertically. In the case where it is installed vertically, it is necessary to install the air sucking apparatus 5 diagonally.

(2) In the above embodiment, the wrapping bag P contained rice, but the wrapping bag P or the packing container can contain substances other than rice, such as coffee, starch, beans, and others, in the form of grains, powder or other solid forms.

(3) In the above embodiment, the puncturing operation and the sealing operation are performed from below the wrapping bag P, but these operations can also be performed above or from the side of the wrapping bag P. In this case, the positions of the puncturing apparatus 15, the air sucking apparatus 5 and other related mechanisms have to be changed accordingly.

(4) As shown by the dotted lines in FIG. 3, a second air blowing pipe 44 can also be provided. This second air blowing pipe 44 serves to blow air onto the front end portion of the seal S as the seal S is peeled off the tape T. As a result, the seal S can be peeled off easily from the tape, even when a seal S having a strong adhesive quality is used.

Figure 9:
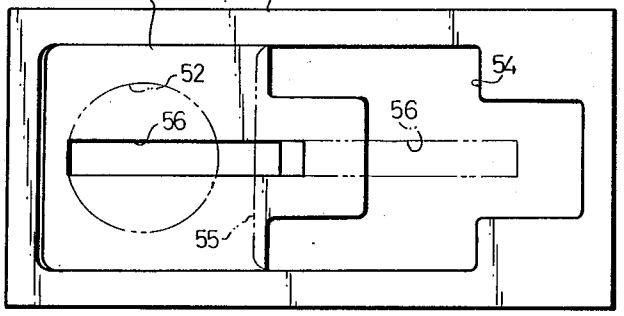
FIG. 9 is a plane figure of the stopper in FIG. 8.
Figure 8:
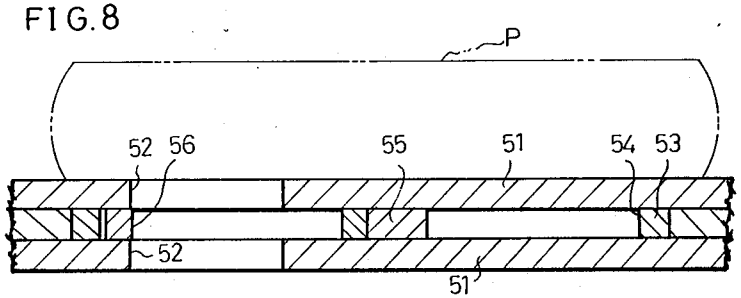
FIG. 8 is a cross sectional view of a modified embodiment.

(5) In the modification shown in FIG. 8, a guide plate 53 is inserted and fixed between a pair of bases 51, each having a sucking hole 52. As shown in FIG. 9, in a hole 54 of the guide plate 53, a stopper 55 is provided such that it is capable of sliding between a first position shown by the solid line and a second position shown by the dotted line. The stopper 55 is selectively moved in a reciprocating manner between these two positions. In the first position, puncturing of and sucking the air from the wrapping bag P are performed via the sucking hole 52 and a hole 56 on the stopper 55. In the second position, placing of the seal S on the wrapping bag P is performed via the sucking hole 52. In this embodiment, before the air sucking operation on the wrapping bag P, excessive sagging of the wrapping bag P into the sucking hole 52 due to the weight of the contents is prevented.

Figure 10:
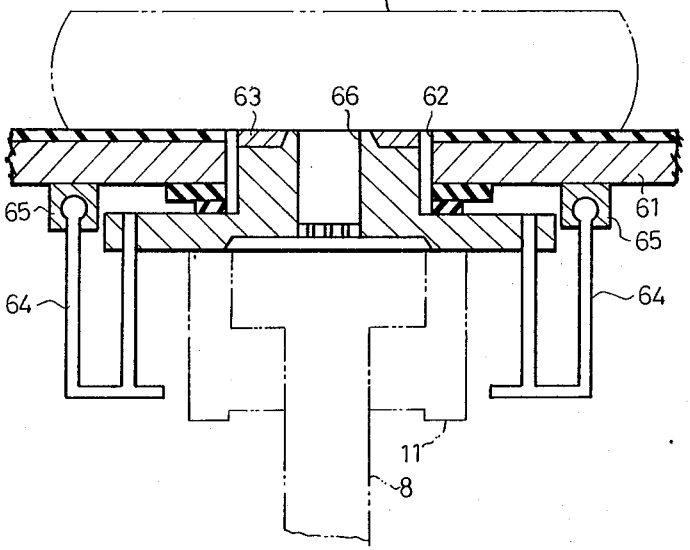
FIG. 10 is a cross sectional view of another modified embodiment.

(6) In the modification shown in FIG. 10, a stopper 63 is provided on the lower surface of a base 61. This stopper 63 is capable of sliding, via a slider 64, between an ascending position where the stopper 63 has advanced into the sucking hole 62 as shown in the illustration, and a descending position where it has moved downward, away from the sucking hole 62. Further, the stopper 63 is capable of moving between an operating position facing the sucking hole 62, via the slider 64 and a guide 65, and a withdrawn position where it is not facing the sucking hole 62. In this embodiment, the puncturing operation is performed on the wrapping bag P in the withdrawn position of the stopper 63. Next, the stopper 63 moves to its operating position and moves upward with the upward movement of the housing 11 until it becomes pressed against the lower surface of the wrapping bag P. Afterward, the stopper 63 again moves to its withdrawn position, and sticking of the seal S on the wrapping bag P is performed. This embodiment also has the same effect as that of the embodiment in FIG. 8.

As many apparently widely different embodiments of this invention may be made without departing from the spirit and scope thereof, it is to be understood that the invention is not limited to the specific embodiments thereof except as defined in the appended claims.

What is claimed is:

1. A vacuum-packing machine comprising:

puncturing means for making holes on a wrapping bag, sucking means functionally connected to said puncturing means, for sucking the air out of wrapping bag through said holes on said wrapping bag, means mounting said puncturing means adjacent said sucking means and attaching means integral to said sucking means, said attaching means being able to be moved independently of said sucking means and to be protruded toward said wrapping bag for sticking a seal on said holes on said wrapping bag while said sucking means keeps sucking the air.

2. A vacuum-packing machine comprising:

puncturing means for making holes on a wrapping bag, sucking means functionally connected to said puncturing means, for sucking the air out of wrapping bag through said holes on said wrapping bag, and attaching means, integral to said sucking means, said attaching means being able to be moved independently of said sucking means and to be protruded toward said wrapping bag for sticking a seal on said holes on siad wrapping bag while said sucking means keeps sucking the air, supplying means functionally connected to said attaching means, for continuously supplying the seal to said attaching means, said supplying means having holding means for holding the seals , blowing means for blowing air in the direction of said attaching means so as to ease the transfer of a seal being supplied by said supplying means to said attaching means.

3. A vacuum-packing machine comprising:

supporting means for supporting wrapping bag, said supporting means having a sucking hole, and said wrapping bag having a surface exposed to said sucking hole, puncturing means for making holes on said exposed surface of said wrapping bag through said sucking hole, provided such that it is capable of approaching and moving away from said sucking hole of said supporting means, sucking means for sucking the air out of said wrapping bag through said holes on said wrapping bag, provided such that it is capable of approaching and moving away from said sucking hole of said supporting means, sealing means provided in said sucking means, said sealing means forming an enclosed space between said exposed surface of said wrapping bag and said sucking means by covering the circumference of said sucking hole of said supporting means when said sucking means moves toward said sucking hole of said supporting means, and attaching means, integral to said sucking means, said attaching means being able to be moved independently of said sucking means and to be protruded toward said wrapping bag, taking a position in said enclosed space when said sucking means approaches said sucking hole and sticking a seal on said exposed surface of said wrapping bag, through said sucking hole of said supporting means, and a said wrapping bag placed on said supporting means, and said means other than said supporting means provided below said supporting means, said supporting means having a stopper for preventing said wrapping bag to sag into said sucking hole before the process of sucking the air out said wrapping bag.

* * * * *